US010894622B2

(12) United States Patent
Overley

(10) Patent No.: US 10,894,622 B2
(45) Date of Patent: Jan. 19, 2021

(54) APPARATUS AND PROCESS FOR PACKING CASES

(71) Applicant: The Procter & Gamble Company, Cincinnati, OH (US)

(72) Inventor: Matthew Bernard Overley, Deerfield Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 423 days.

(21) Appl. No.: 15/371,547

(22) Filed: Dec. 7, 2016

(65) Prior Publication Data

US 2017/0166336 A1 Jun. 15, 2017

Related U.S. Application Data

(60) Provisional application No. 62/267,300, filed on Dec. 15, 2015.

(51) Int. Cl.
*B65B 25/14* (2006.01)
*B65B 5/06* (2006.01)
(Continued)

(52) U.S. Cl.
CPC ..... *B65B 25/146* (2013.01); *B65B 5/06* (2013.01); *B65B 35/40* (2013.01); *B65B 39/007* (2013.01); *B65B 43/42* (2013.01)

(58) Field of Classification Search
CPC ..... B65B 25/146; B65B 43/42; B65B 39/007; B65B 35/40; B65B 5/06
See application file for complete search history.

(56) References Cited

U.S. PATENT DOCUMENTS 3,823,811 A 7/1974 Brockmuller
3,916,600 A * 11/1975 Falt ..... B65B 5/00 53/142
(Continued)

FOREIGN PATENT DOCUMENTS

DE 12 12 854 B 3/1966
DE 10 2008 007441 B3 7/2009
DE 20 2011 110089 1/2013

OTHER PUBLICATIONS

U.S. Appl. No. 15/597,254, filed May 17, 2017, Matthew Bernard Overley.
(Continued)

*Primary Examiner* — Anna K Kinsaul
*Assistant Examiner* — Daniel Jeremy Leeds
(74) *Attorney, Agent, or Firm* — Richard L. Alexander; Andrew J. Mueller

(57) ABSTRACT

An apparatus for packing cases with stacked rolled product. The apparatus can include a shuttle for receiving stacked rolled product, the shuttle operatively positioned to receive the stacked rolled product and translate the stacked rolled product from a first position to a second position. A rotatable and translatable loading head can be operatively positioned to receive the stacked rolled product from the second position of the shuttle. A first loading pusher can be operatively positioned to push the stacked rolled product from the second position of the shuttle to the loading head. A carton conveyor can be operatively positioned to convey open cartons to receive the stacked rolled product from the loading head.

11 Claims, 4 Drawing Sheets

(51) Int. Cl.

| | |
|---|---|
| ***B65B 35/40*** | (2006.01) |
| ***B65B 43/42*** | (2006.01) |
| ***B65B 39/00*** | (2006.01) |

(56) References Cited

U.S. PATENT DOCUMENTS

| | | | | | |
|---|---|---|---|---|---|
| 4,077,179 | A | | 3/1978 | Lancaster | |
| 4,545,476 | A | | 10/1985 | Calvert | |
| 4,679,379 | A | * | 7/1987 | Cassoli | B65B 9/073 100/232 |
| 4,750,317 | A | * | 6/1988 | Vrana | B65B 5/06 53/247 |
| 4,875,328 | A | * | 10/1989 | Meyer | B65B 25/146 53/529 |
| 5,129,211 | A | * | 7/1992 | Andersson | B65B 9/026 53/399 |
| 5,328,319 | A | * | 7/1994 | Fadaie | B65B 5/08 294/87.1 |
| 5,553,442 | A | * | 9/1996 | Fadaie | B65B 25/146 414/404 |
| 5,578,331 | A | * | 11/1996 | Martin | B29D 11/0024 425/445 |
| 5,732,536 | A | * | 3/1998 | Lin | B65B 5/106 53/245 |
| 5,873,450 | A | | 2/1999 | Rusch | |
| 7,643,901 | B2 | * | 1/2010 | Ponti | B65G 47/086 700/217 |
| 7,757,466 | B2 | * | 7/2010 | Conti | B65B 29/025 53/540 |
| 8,413,407 | B2 | * | 4/2013 | Barsacchi | B65H 19/123 53/118 |
| 8,468,781 | B2 | * | 6/2013 | Fritzsche | B65B 35/52 53/447 |
| 10,011,377 | B2 | * | 7/2018 | Oyama | B65B 39/02 |
| 10,259,661 | B2 | | 4/2019 | Overley et al. | |
| 10,427,886 | B2 | | 10/2019 | Overley et al. | |
| 2002/0116895 | A1 | * | 8/2002 | Antoniazzi | B65B 51/14 53/230 |
| 2005/0166552 | A1 | * | 8/2005 | Omo | B65G 47/086 53/443 |
| 2007/0107385 | A1 | * | 5/2007 | Dall'omo | B65G 57/32 53/433 |
| 2008/0229709 | A1 | * | 9/2008 | Dall'omo | B65B 25/146 53/211 |
| 2009/0218193 | A1 | | 9/2009 | Malini | |
| 2012/0233967 | A1 | * | 9/2012 | Bellante | B65B 5/105 53/443 |
| 2013/0068589 | A1 | * | 3/2013 | Overley | B65G 29/00 198/418.1 |
| 2013/0068591 | A1 | * | 3/2013 | Overley | B65G 29/00 198/470.1 |
| 2013/0334008 | A1 | * | 12/2013 | Overley | B65B 35/50 198/418 |
| 2014/0026524 | A1 | * | 1/2014 | Rooyakkers | B65G 57/035 53/446 |
| 2015/0329230 | A1 | * | 11/2015 | Rasi | B65B 39/02 53/443 |
| 2017/0327265 | A1 | * | 11/2017 | Vistrom | B65B 43/08 |
| 2018/0148271 | A1 | | 5/2018 | Svenningsen | |

OTHER PUBLICATIONS

PCT International Search Report dated Aug. 24, 2017—5 pages.
PCT International Search Report for related case 14155 dated Aug. 23, 2017—6 pages.
All Office Actions U.S. Appl. No. 15/597,254.
Written Opinion.
All Office Actions U.S. Appl. No. 16/287,429.

* cited by examiner

APPARATUS AND PROCESS FOR PACKING CASES

FIELD OF THE INVENTION

The present invention is related to apparatuses and processes for conveying and packing rolled products, including packaged rolled products such as rolled toilet paper and paper towels.

BACKGROUND OF THE INVENTION

Products made from absorbent fibrous webs are used for a variety of purposes. For example, rolled absorbent products such as paper towels and toilet tissues are in constant use in modern industrialized societies. Such rolled products, as well as related products including facial tissues, napkins, and the like, are typically packaged for retail sale in flexible polymer packaging. Packaging can include single rolls in a polymeric film wrapper or packages of multiple rolled products bundled into a single larger polymeric film wrapper.

Current approaches to forming packages of rolled products for retail sale include well known "bundling" and "case packing" technologies. Generally, rolled absorbent products can be wrapped in individual polymer wrappers and then laned and layered into stacked configurations of multiple packages that are then either bundled by being placed into a polymer over wrap, or case packed into a rigid cardboard carton.

Whether bundled or case packed, the laned, stacked rolled absorbent products require handling including reorientation prior to being bundled or case packed. Generally, the bundling or case packing transformations are achieved on separate lines where the transformations are largely redundant.

There is a continuing unmet need for an apparatus and method for more efficient, cost effective, and flexible bundling and case packing.

SUMMARY OF THE INVENTION

An apparatus for packing cases with stacked rolled product is disclosed. The apparatus can include a shuttle for receiving stacked rolled product, the shuttle operatively positioned to receive the stacked rolled product and translate the stacked rolled product from a first position to a second position. A rotatable and translatable loading head can be operatively positioned to receive the stacked rolled product from the second position of the shuttle. A first loading pusher can be operatively positioned to push the stacked rolled product from the second position of the shuttle to the loading head. A carton conveyor can be operatively positioned to convey open cartons to receive the stacked rolled product from the loading head.

DETAILED DESCRIPTION OF THE INVENTION

The present invention is an improvement to bundling and case packing apparatuses and processes. The apparatus can include a shuttle for receiving stacked rolled product from an infeed conveyor. The shuttle can translate the received stacked rolled product in one of any number of directions, but is best illustrated by a shuttle that can translate in two opposite directions away from the position at which the infeed conveyor deposits the stacked, rolled product. After translation on the shuttle, a pusher can push the stacked rolled product to a loading head. The loading head can be part of an articulating arm robot having sufficient degrees of motion to manipulate the received stacked rolled product and place it in either a bundle or a case.

Figure 1:
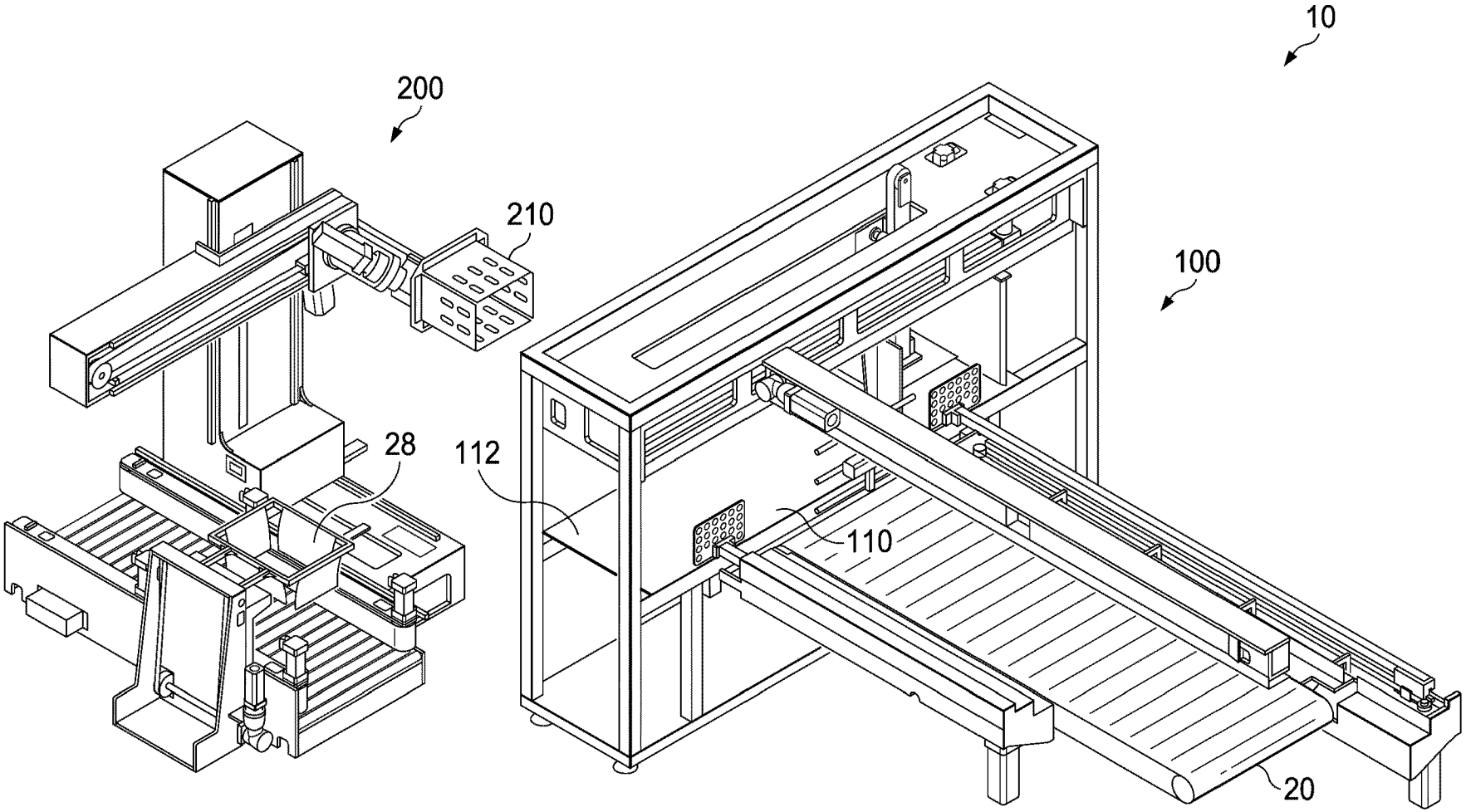
FIG. 1 is a perspective view of a of an apparatus of the present invention.

An example of the present disclosure is shown in FIG. 1 showing apparatus 10 having a shuttle 100 and a loader 200. Shuttle 100 is shown in more detail in FIG. 2, and loader 200 is shown in more detail in FIG. 3. The shuttle 100 and the loader 200 are operatively positioned such that the shuttle 100 can move a stack of rolled absorbent products 26 received from an infeed conveyor 20 at a first position 110 on shuttle 100 to a second position 112 on shuttle 100 from which the loading head 210 of loader 200 can receive the stack of rolled absorbent products 26 and subsequently deposit the stack of rolled absorbent products into a bundle or carton 28.

By "stack" as used herein, is meant any grouping of rolled products into one or more rows, one or more lanes, and one or more layers, and that the rolled products which make up the stack can be in any orientation, of which the orientation all of the products making up the stack is usually, but not necessarily, homogenous.

By "operatively positioned" as used herein is meant that two or more components of the apparatus are positioned such that their intended functions can be achieved. Thus, without requiring any predetermined spatial or dimensional requirements, two components are operatively positioned to one another when they are positioned to carry out their respective intended interactions.

Figure 2:
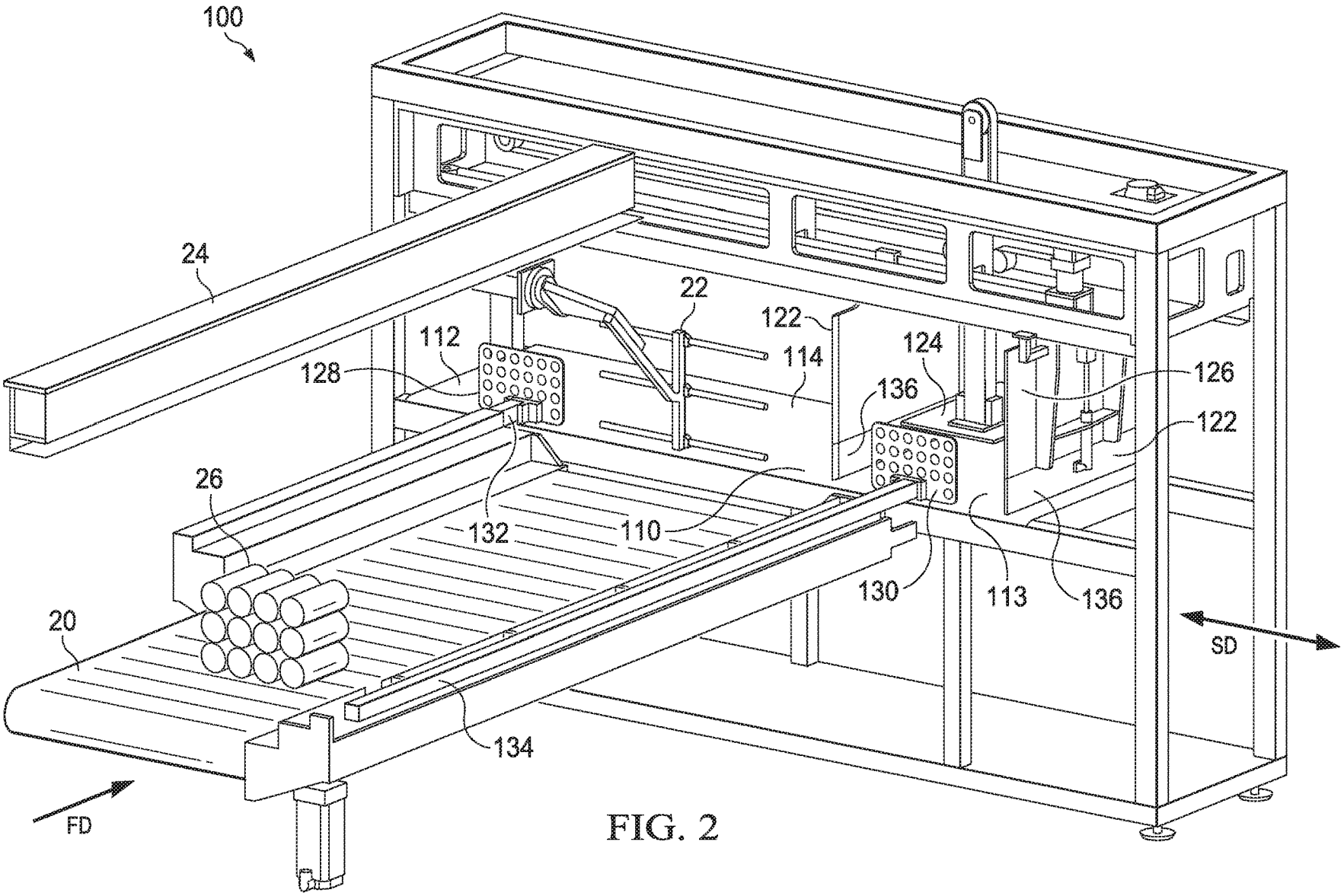
FIG. 2 is a perspective view of a of an apparatus of the present invention.
Figure 4A:
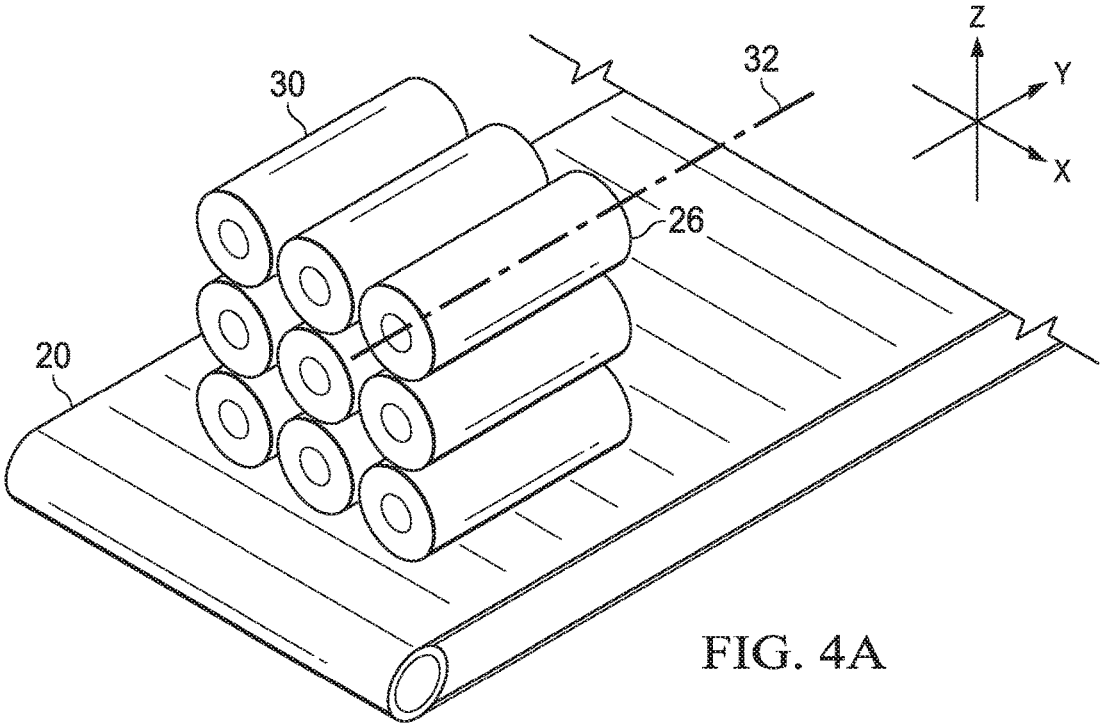
FIG. 4A is a representative example of stacked rolled product.
Figure 4B:
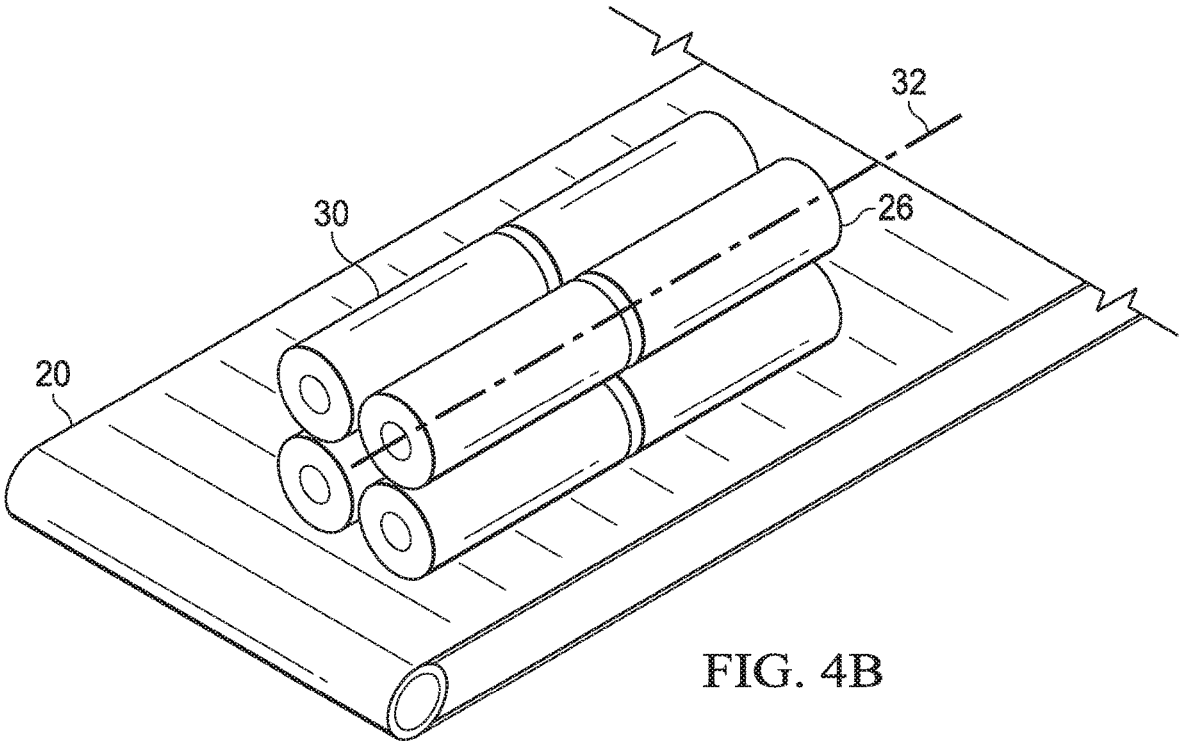
FIG. 4B is a representative example of stacked rolled product.

In an example shown in FIG. 2, the shuttle 100 is operatively positioned with respect to the infeed conveyor 20 which moves stacked rolled absorbent products 26 in a first direction indicated as FD. The stacked rolled absorbent products 26 can have been laned and layered in an earlier, upstream process, and can be partially wrapped when conveyed to the shuttle 100. The stacked rolled absorbent products 26 can take any configuration desired by the manufacturer for retail sale. Several variations of configurations are shown by way of example in FIG. 4. The non-limiting examples of FIGS. 4A and 4B show two of any variety of laned, stacked individual rolled absorbent products 30, that make up a stacked rolled product 26 which the shuttle and loader operate to manipulate for bundling or cartoning. As can be seen, stacked rolled product 26 can be moved on conveyor 20 in the X-Y plane with the cores of each individual rolled absorbent product 30 being parallel to one another, and parallel to the X-Y plane, and oriented such that their respective axes 32 are oriented in the Y-direction.

The shuttle 100 has a translation surface 114 onto which the stacked rolled products 26 can be translated in a second direction indicated as SD. The second direction SD can be orthogonal to the first direction FD, either right or left of the first position 110, and the translation surface 114 can be in the same plane as the surface of the conveyor 20. The translation surface 114 can be a smooth, low-friction deadplate. In an embodiment, the translation surface can include a conveyor that indexes with the movement of the pair of adjustable opposing side plates 122 (discussed below) to minimize or eliminate sliding friction.

The shuttle 100 can have a pair of adjustable opposing side plates 122 and an adjustable upper plate 124 that act in concert to contain the stacked rolled product 26 in the stacked configuration while being translated from the first position 110 to another position, such as second position 112. Thus, the opposing side plates 122 and adjustable upper plate 124 can apply slight pressure to the stacked rolled product such that the stack configuration is not disturbed during translation. In an embodiment, at the end of translation more pressure can be applied by the opposing side plates to compress the stack down to the case dimensions or to make a tight bundle. As such, the opposing side plates 122 and upper plate 124, with other components as desired, are termed herein as a stack stabilizer 126. Stack stabilizer 126 can be adjustable to accommodate various sizes of stacked rolled product, and can move in either second direction SD, i.e., right or left of the infeed conveyor, from a first position 110 to a second position 112 or a third position 113.

In the example shown in FIG. 2, the stack stabilizer 126 is shown at third position 113. Stacked rolled product 26 can be delivered to first position 110 by being pushed off of the conveyor 20 and onto the translation surface 114 by a conveyor pushing device 22 that can articulate in a reciprocating motion by motor and control means known in the art on track 24 to push off the stacked rolled product 26 in the first direction FD onto the translation surface 114 at first position 110.

In practice, stacked rolled product 26 delivered to the translation surface 114 need not be identical to previous or subsequent stacked rolled product 26. That is, the apparatus of the invention can operate to handle differing configurations of stacked rolled product 26, with the result being increased flexibility in packing cartons or bundles of differing stack configurations as desired to fulfill customer demands.

In operation, the stack stabilizer 126 can be positioned at the first position 110 to receive the stacked rolled product 26 being pushed off of conveyor 20 onto the translation surface 114. The opposing side plates 122 and upper plate 124 can be adjusted via mechanical linkage, such as hydraulic linkage, servo motor driven linkage, or the like, to closely contain the stacked rolled product 26 in its stacked configuration and translate the stacked rolled product 26 by moving in the second direction SD toward second position 112 while sliding the stacked rolled product on translation surface 114.

Once the stacked rolled product 26 is on the translation surface at second position 112, a first loading pusher 128 can push the stacked rolled product off of the translation surface, with the pushing direction being parallel to the first direction FD. Likewise, once the stacked rolled product 26 is on the translation surface at third position 113, a second loading pusher 130 can push the stacked rolled product off of the translation surface, with the pushing direction being parallel to the first direction FD. As can be understood from FIG. 2, the first loading pusher 128 can be attached to a first pushing arm 132 with can move back and forth in a direction parallel to the first direction FD. In FIG. 2 it is shown in a retracted position, waiting for the stacked rolled product to be moved to the second position 112 by the stack stabilizer 126. Once the stack stabilizer 126 moves the stacked rolled product to the second position 112, and the first pushing arm 132 extends in a direction parallel to the first direction to push the stacked rolled product off of the translation surface 114, the stack stabilizer 126 can return to the first position 110 for the next stacked rolled product 26. The side plates 122 of the stack stabilizer 126 can have folding flaps 136 at the lower, distal edges, the folding flaps 136 being sufficiently sized so as to be folded upwardly to clear the first pushing arm 132 when the stack stabilizer 126 moves back to the first position 112. Flap movement can be controlled by mechanical linkage, such as hydraulic linkage, servo motor driven linkage, or the like.

Once the stacked rolled product is pushed off of the translation surface 114 at the second position 112, the stacked rolled product can be received by a loading head 210 for loading into a bundle or carton. In the disclosed embodiment one loader 200 is illustrated with a loading head 210 for loading cartons.

Figure 3:
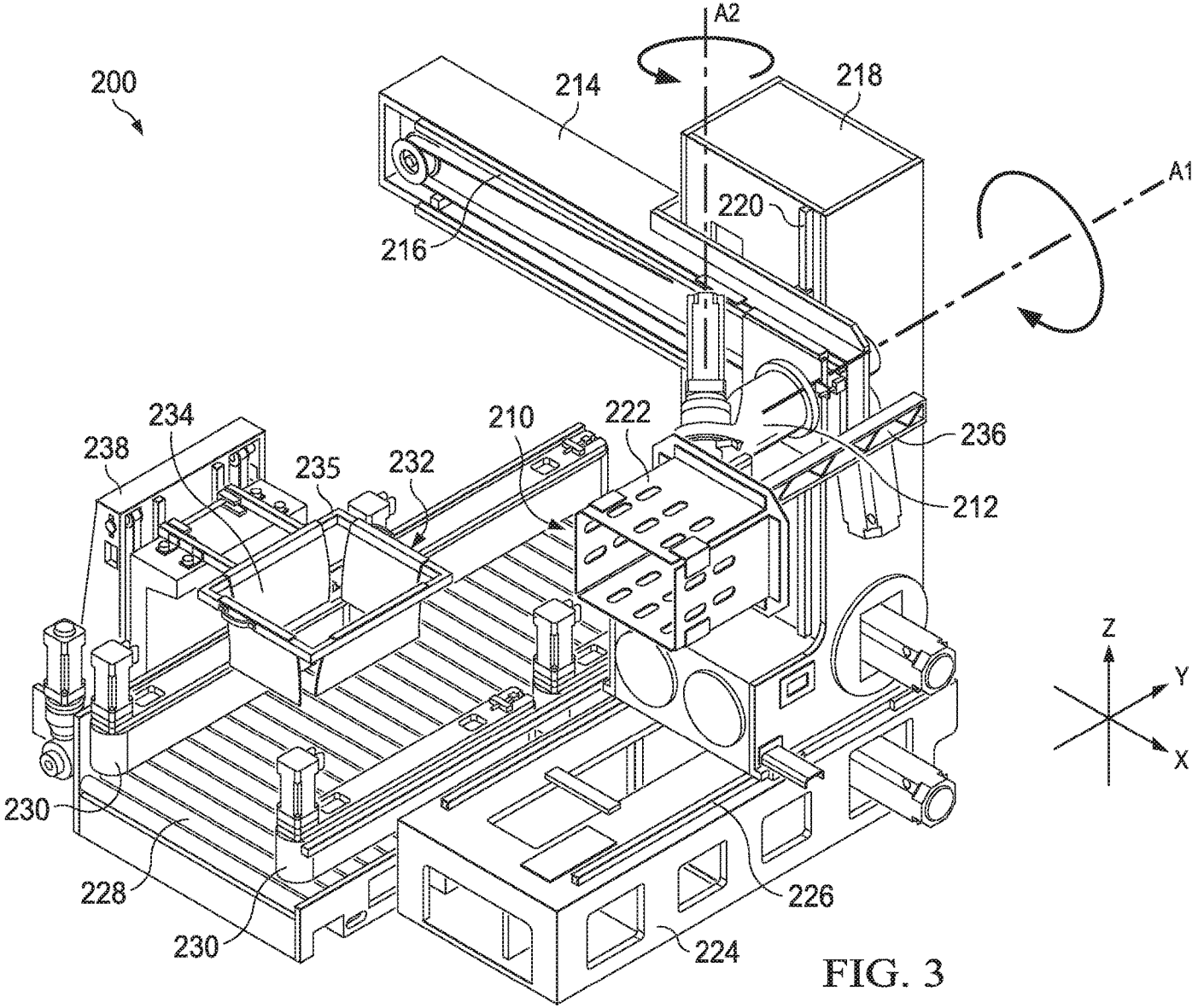
FIG. 3 is a perspective view of a of an apparatus of the present invention.

An exemplary loader 200 is shown in FIG. 3. The loader 200 is operatively positioned with respect to the shuttle 100 such that the loading head 210 can receive the stacked rolled product as it is pushed off of the translation surface by the first loading pusher 128. The loading head 210, which can have adjustable loading head plates 222 for holding and securing the stacked rolled product, can be attached to a robot arm 212 which can be moveable about the X, Y, and Z Cartesian axes, as well as rotatable about the Y axis, designated as first axis A1. In addition, the loading head 210 can be rotatable about a 120 degree rotation about a second axis A2 so that the loading head can receive the stacked, rolled product 26 horizontally and discharge it vertically. That is, in an exemplary apparatus, the stacked rolled product enter the loading head with the central axes 32 of the respective cores 34 of the rolled products being parallel to a plane of the translation surface, which is "horizontal" in this description, can be described as having the axes 32 of their respective cores 34 parallel to the Y-direction. When placed into a carton 36, as described below, the axes 32 of the respective cores 34 of the rolled products 30 can be perpendicular to a plane of the translation surface 114, which is "vertical" in this description, and can be described as being parallel to the Z-direction. As can be understood, the 120 degree gearbox combines movement of two axes of rotation into one, and permits in one continuous motion the stacked rolled product 26 to be placed in the carton 36 with their respective cores 34 vertically oriented, which aids in keeping the cartons stable when stacked by providing relatively rigid columnar support to the carton.

The loading head 210 can articulate about the X, Y, and Z Cartesian coordinates because it is joined to robot arm 212, which can be moved as is known in the art for robot arms. The robot arm 212 can be moveably attached to a first support member 214, which can have a first support member track 216 upon which the robot arm can move back and forth in the X-direction by drive and control means well known in the art. Likewise, first support member 216 can be moveably attached to a second support member 218, which can have a second support member track 220 upon which the first support member 214 can move back and forth in the Z-direction by drive and control means well known in the art, thus also moving the robot arm 212 in the Z-direction. Finally second support member 218 can be moveably attached to a third support member 224, which can have a third support member track 226 upon which the second support member 218 can move back and forth in the Y-direction by drive and control means well known in the art, thus also moving the robot arm 212 in the Y-direction.

In operation, a carton conveyor 228 can be operatively positioned with respect to loader 200 to convey cartons, such as cardboard boxes, having the flaps open at the top for loading. In an embodiment, an optional a flap spreader device 232 can be utilized to aid in keeping the open flaps of the carton from interfering with the loading operation. The flap spreader device 232 can have flexible panels 234 attached to a flap spreader device frame 235 which itself can be moveable and adjustable at least in the Z-direction by being moveably attached to flap spreader support 238 by drive and control means known in the art. When lowered over an open carton, the flexible panels 234 can press the carton flaps outwardly and away from the carton opening, thereby ensuring that carton can be loaded without interference from the carton flaps.

Once a carton 36 has been moved on the carton conveyor 228 into a position for loading by the loader 200, for example once the carton is positioned under the flap spreader device 232 and the flap spreader device lowered so as to ensure the carton flaps do not interfere with loading, the loading head 210 can be articulated by translation and rotation such that the loading head 210 which received rolled absorbent products with their core axes parallel to the Y-direction can deposit the stacked rolled products into the carton with their core axes parallel to the Z-direction. To aid in depositing the stacked, rolled products into the carton, a carton loading pusher 236 can be utilized, the carton loading pusher 236 being moveable back and forth in the Z-direction for carton loading to push the stacked, rolled product out of the loading head 210 and into the carton.

The description above can be applied to a second loader 200, or to the same loader 200 described, to receive stacked rolled product from third position 113, which product can be similarly placed into polymer bags, i.e., bundles for shipping to customers. Therefore, the apparatus 10 of the present invention can efficiently convert stacked rolled products into either cartons or bundles, without necessitating redundant converting components, such as multiple infeed conveyors, or requiring large mechanisms to be moved in and out of place. By utilizing the shuttle 100 to shuttle stacked rolled product either to second position 112 for cartoning, or to third position 113 for bundling, all the upstream laning, stacking, and conveying equipment can be shared, with the cartoning or bundling step being achieved by the apparatus 10 after the upstream processes.

In another example, the apparatus described above could be modified to have more than one infeed conveyor 20. For example, the shuttle could be served by two infeed conveyors, each delivering stacked rolled product 26 to, for example, one of the second position 112 or third position 113. The stack stabilizer 126 of the shuttle 100 can then translate the stacked rolled product 26 to another position, such as first position 110 for discharge to the loading head 210. For example, the system and apparatus can be set up as generally described above but with two or more infeed conveyors feeding one or more discharge positions from which downstream packing operations can be fed rolled absorbent product for either cartoning or bundling.

In any embodiment, the apparatus of the invention permits various stacked rolled product 26, that is, stacked rolled product of varying numbers of lanes, rows, and stacks, to be outputted to a desired package, i.e., a carton or a bundle. Thus, the upstream operations of laning, creating rows, and making stacks can be decoupled from the downstream packing requirements. The upstream operations can supply the same stacked rolled product configuration, or different stacked rolled product configurations, with the downstream packing operations achieving the desired casepacking or bundling as desired.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

The invention claimed is:

1. An apparatus for packing cases comprising:

a. a shuttle for receiving unpackaged stacked rolled product from a first direction, the shuttle comprising a translation surface and a stack stabilizer that has at least two side plates, the shuttle operatively positioned to receive the unpackaged stacked rolled product between the at least two side plates of the stack stabilizer and to translate the unpackaged stacked rolled product on top of the translation surface along a second direction, wherein the first direction is different from the second direction, and wherein the first direction terminates at a first position and the second direction terminates at a second position or a third position;

b. a first loading pusher operatively positioned to push the unpackaged stacked rolled product from the second position of the shuttle into a cartoning process;

c. a second loading pusher operatively positioned to push the unpackaged stacked rolled product from the third position of the shuttle into a bundling process; and d. a loading head, the loading head operatively positioned to receive the unpackaged stacked rolled product from the second position of the shuttle, wherein the loading head is rotatable and translatable.

2. The apparatus of claim 1, wherein the first direction is substantially orthogonal to the second direction.

3. The apparatus of claim 1, wherein the cartoning process comprises a carton conveyor operatively positioned to convey open cartons, and wherein the open cartons have open flaps, and the apparatus further comprises a flap spreader operatively positioned with the open cartons to keep a flap of the carton from interfering with the loading of the carton.

4. The apparatus of claim 1, wherein the rotatable and translatable loading head receives the unpackaged stacked rolled product in a first orientation and wherein open cartons receive the unpackaged stacked rolled product in a second orientation.

5. The apparatus of claim 1, wherein the rotatable and translatable loading head comprises opposing gripping plates for compressing and holding the unpackaged stacked rolled product and a loading head pusher plate for pushing the unpackaged stacked rolled product from the loading head into an open carton.

6. The apparatus of claim 5, wherein the loading head comprises two opposing pairs of gripping plates, and at least one opposing pair is actuated such that distal ends converge inwardly to hold the unpackaged stacked rolled product.

7. The apparatus of claim 1, wherein the unpackaged stacked rolled product moves along the first direction on a conveying surface.

8. The apparatus of claim 7, wherein the conveying surface comprises an axis ("FD") along the first direction.

9. The apparatus of claim 8, wherein the first and second loading pushers are on opposite sides of the axis.

10. The apparatus of claim 8, wherein the second and third positions are on opposite sides of the axis.

11. The apparatus of claim 8, wherein the axis intersects with the first position.

* * * * *